United States Patent [19]

McClure

[11] 4,342,477

[45] Aug. 3, 1982

[54] SECURITY SEAL WITH BREAK-OFF SCREW HEAD SECUREMENT

[75] Inventor: Kenneth R. McClure, St. Charles, Ill.

[73] Assignee: Dickey Manufacturing Company, St. Charles, Ill.

[21] Appl. No.: 124,074

[22] Filed: Feb. 25, 1980

[51] Int. Cl.[3] ..... B65D 33/34

[52] U.S. Cl. ..... 292/307 R; 24/135 N

[58] Field of Search ..... 292/307, 308, 315, 319; 24/115 H, 135 N

[56] References Cited

U.S. PATENT DOCUMENTS

| | | | |
|---|---|---|---|
| 501,042 | 7/1893 | Brooks | 292/308 |
| 1,038,183 | 9/1912 | Mueller | 292/327 X |
| 2,469,592 | 5/1949 | Byer | 292/327 X |
| 3,268,965 | 8/1966 | Arthur | 24/135 N |

FOREIGN PATENT DOCUMENTS

| | | | |
|---|---|---|---|
| 193923 | 3/1923 | United Kingdom | 24/135 N |

*Primary Examiner*—Richard E. Moore

*Attorney, Agent, or Firm*—McWilliams, Mann & Zummer

[57] ABSTRACT

A security seal comprising a tie member that forms the seal shackle and a retainer in the form of a block or body in which the tie member ends are anchored when the device is in use as a seal. Manual anchoring of the tie member in the retainer, in applying the seal, is by way of applying the tie member to a through passage formed in the retainer block or body, which block or body also has formed in same a bore that extends crosswise of and intersects and crosses said through passage, between a mouth of same in a side surface of the retainer, on one side of the passage, and a recess the bore forms on the other side of the passage. The bore threadedly mounts on said one side of the passage a screw headed hand tool associated with the seal, which hand tool defines a screw head that is proportioned to be recess mounted in the cross bore, and a break-away throw-away handle made integral with the screw head by a frangible connection that is to be located well within the cross bore when the screw head is properly applied to the retainer. The screw headed hand tool is turned to place the working end of the screw head against the tie member disposed in the retainer through passage to deflect same into the internal recess defined by the retainer cross bore, and thus internally anchor the tie member in the retainer. The throw-away handle is then broken off to leave the screw head recessed well within the cross bore and spaced and shaped to resist violation of the security seal. The seal is illustrated in cable seal and money bag seal embodiments.

6 Claims, 13 Drawing Figures

SECURITY SEAL WITH BREAK-OFF SCREW HEAD SECUREMENT

This invention relates to a security seal of the safety or tamperproof type, and more particularly, to cable seals, money bag seals, and other forms of security seals where a major function of the seal is to deter thievery or even tampering with the seal by being arranged to indicate that the seal has not been violated by indicating freedom from tampering, as distinguished from physically preventing removal.

Seals of this general type are commonly used to seal truck or rail shipments, electric meters, airline liquor kits, fire extinguishers, and the like, where a major function is not so much to resist breaking the seal as it is to indicate that the seal has been broken or tampered with. Examples are the familiar money bag seals and the common plastic seal. Cable seals, while used for the same purpose, are also intended to resist tampering by offering effective resistance to being pried or broken open. A basic intention for seals of this type is that if they are forced open, the seal is destroyed, and reuse is not possible, in addition to indicating that the seal has been tampered with even if not forced.

This invention is concerned with seals of this general type in which the shackle or loop is provided by a length of flexible or semiflexible cable or cording, that is this disclosure is referred to generically as the seal tie member. In cable seals, the tie member is represented by the length of cable employed; in money bag seals it is represented by the length of cording that is employed.

In cable seals, the tie member that is formed by the length of cable has one end suitably embedded in the seal retainer block or body, with the seal retainer block or body being formed from a malleable metal, and being shaped to receive the other end of the cable when the seal is applied padlock fashion to lock or secure something closed. The cable free end is commonly fixed in place by clamping or hammering the retainer block or body to compress the block or body against the tie member free end in question and bind the two parts together.

In money bag seals, the length of cord that serves as the tie member is looped several times through the seal block or body, the latter being conventionally in the form of a flat segment of lead or the like having a length and width dimension comparable to the diameter of a dime, and that is formed with multiple through passages for receiving the cord so that the cord defines several bight portions that may be placed in aligned relation to receive the mouth of the money bag to be closed by the seal. The bag mouth is closed by pulling the cord ends relative to the seal retainer to close the loops about the bag mouth and against an angular abutment mounted on the cord loops between the loop bight portions and the retainer, after which the retainer body or block is deformed by clamping or hammering to bind the cord to the retainer against release.

Seals of this general types are widely used, but as they contemplate a deforming of a major part of the seal retainer body or block to fix the adjustable tie member portions against release, appropriate hand tools such as clamps or hammer and anvil are required which frequently are not conveniently at hand or readily usable at the locale where the seal is applied. Furthermore, the deforming of the block or body tends to be haphazard at best and when carelessly done the adjusting seal tie member portion can be left sufficiently loose so that the connection that was established between what was the tie member adjusting portion and the seal retainer block or body can be too readily forced for adequate sealing purposes.

While set screws and clamping devices per se might seem appropriate for incorporating in the retainer fixing tie member adjustable portions in place in locked relation relative to the seal retainer, arrangements of this type have not been satisfactory for this general category of seals as they ordinarily are readily loosened by unauthorized persons using suitable tools to undo what was done in applying the seal.

A principal object of the present invention is to provide a security seal of the flexible tie member type in which the portion of the tie member that is to be adjusted or manipulated relative to the retainer for securement purposes is fixed to the seal retainer to hold the seal in locked relation without requiring any major deformation of the retainer in applying the seal, and which leaves the seal effectively unopenable without destroying the seal.

A further and more specific principal object of the invention is to provide a security seal of the flexible tie member type in which the tie member adjusting portion or portions are lodged within the seal retainer block or body and are fixed in place using a screw headed hand tool that recesses the screw head within the retainer in firm bearing relation with the tie member portion to be fixed in place, and provides for breaking off of the tool handle to both leave the screw head seated out of access within the retainer, and condition the fractured end of the screw head so that by shape and hardness it resists removal by drilling or the like.

Another important object of the invention is to provide a cable seal and an associated screw headed hand tool therefore in which the hand tool has a screw body portion that is turned by using the hand tool handle to recess the screw body portion within the retainer to fix the cable free end in locking position and within the retainer, and a break-away throw-away handle portion connected thereto by a hardened frangible connection that is fractured as part of the seal securement procedure, to leave the screw body portion irretriveably recessed in the retainer and set against the cable end that was formerly free.

Yet another important object of the invention is to provide a seal of the money bag type in which the retainer is formed with a single through passage in which both ends of the cord that forms the tie member are extended to form a single money bag open end grasping loop, on which the conventional angular bag abutment may be mounted, whereby after the loop is closed against the money bag open end to close same against the bag abutment, the tie member portions within the retainer are fixed to the retainer by employing an associated screw headed hand tool with a break-away throw-away handle that is employed to set the screw head of the hand tool in firm bearing relation to the tie member, and that is broken off to leave the screw head irretriveably recessed in the retainer.

Other objects of the invention are to provide a tamper proof security seal that is of few and simple parts, that requires or needs no tools to lock same other than the screw headed hand tool that accompanies same, that requires destruction of the associated hand tool to properly apply the seal, that effectively resists release of the tie member from the seal retainer short of destroying the seal, and that is economical of manufacture, convenient to use, and applicable to a wide variety of security seal applications.

In accordance with the invention, a security seal is provided in which the seal retainer block or body is formed with a through passage to receive the tie member portion or portions that are to be adjusted relative to the retainer to apply the seal as needed. The seal retainer body or block also has formed in same a bore that extends crosswise of and intersects and extends across the through passage from a mouth or access opening and a side surface of the retainer to the far side of the through passage, where the bore inner end defines a recess within the retainer. The retainer cross bore is threaded to threadedly receive the hand tool screw head that is in the form of a short screw body having a protuberant working or head end that, when the tie member is positioned relative to the retainer to place the seal in its locking relation, is set in firm bearing or pressure applying relation against the tie member to indent same into the retainer inner recess, by turning the screw body into the retainer, using the tool handle for this purpose. When the screw body is properly set against the tie member, the hand tool is broken off at a hardened frangible connection located well within the retainer cross bore to both recess the screw body within the retainer and condition the outwardly directed end of same to resist dropping out.

Still other objects, uses and advantages will be obvious or become apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws and that the invention is susceptible of modifications and variations that will be obvious to those skilled in the art, and which are intended to be covered by the appended claims.

Figure 1:
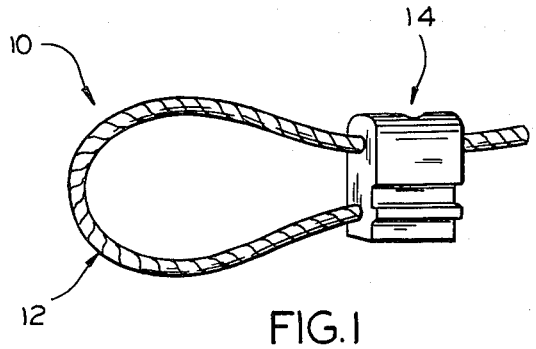
FIG. 1 is a diagrammatic perspective view of the cable seal arranged in accordance with the invention.

Referring first to the embodiment of FIGS. 1–5, reference numeral 10 generally indicates a cable seal arranged in accordance with the invention which comprises a length of cable 12 that forms the shackle of the device 10 and the aforementioned tie member of this embodiment, and that is secured to the seal retainer 14. The seal 10 in the showing of FIG. 1 is shown in its closed or locked relation, and for purposes of this disclosure it may be assumed that the seal 10 has been closed to hold something closed, such as a door of a railroad boxcar, or highway trucking vehicle, and also serve to indicate that the door has been sealed shut for security purposes.

The retainer 14 generally comprises, for seal 10, a block or body 16 formed from a metallic malleable material, such as aluminum, to define a pair of through passages 18 and 20 that are in parallelism, and extend entirely between planar end walls 22 and 24 of the block or body 16.

The block or body 16 also defines in the form illustrated a planar underside 24, a rounded edge wall 26, a planar edge wall 28, and a planar front or top wall 30 that is grooved or recessed as at 32 and 34 to define upstanding ridge 36 that is aligned with and parallels the through passage 18.

The block or body 16 is also formed to define a cross bore 40 leading from a mouth 42 formed in the edge wall 26 and extending in normal, intersecting relation with the through passage 20. The bore 40 extends across the passage 28 to define a bore portion 43 extending between the mouth 42 and the passage 20, and a portion 45 on the other side of the passage 20 that defines recess 46.

Figure 2:
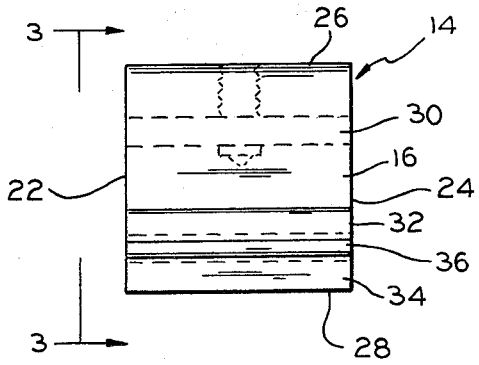
FIG. 2 is a plan view of the seal retainer block or body, as viewed in FIG. 1.
Figure 5A:
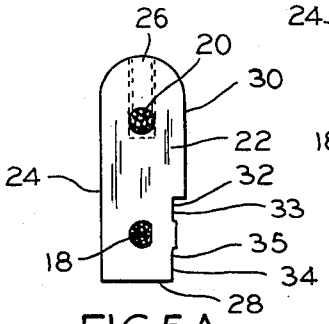
FIG. 5A is a view taken along line 5A—5A of FIG. 5.
Figure 3:
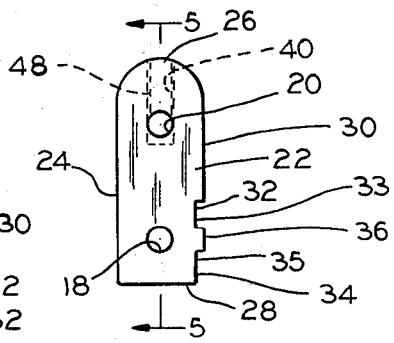
FIG. 3 is an end view of the seal retainer block or body, taken along viewing line 3—3 of FIG. 2.

As will be observed from FIGS. 2, 3 and 5A, the retainer 14 is generally flat or planar in configuration and the through passages 18 and 20, and bore 40, are in coplanar relation in the plane of the body 16.

The bore 40 is internally threaded as at 48 to threadedly receive the screw headed hand tool 50 that accompanies the seal 10. Hand tool 50 comprises head portion 52 and handle portion 54 that are integrally connected by a frangible connection indicated at 56. The tool head portion 52 comprises a screw body 58 that is externally threaded as at 60 for threaded cooperation with the internal threading 48. Body 58 is formed with a working front or leading end 62 that is of conical configuration to define a pointed terminal portion 64.

The tool handle 54 includes shank portion 66 and hand grip portion 68 that is disposed at right angles to the shank portion 66.

The frangible connection 56 is defined in the embodiment illustrated by annular groove 70 formed by machining the shank 66 to first define reduced shank portion 72 and the diagonally oriented, converging edge surfaces 74 and 76 that reduce to a breakable size the diameter of the shank 66 where the handle 54 is thus integrally connected with the screw head 58. Surfaces 74 and 76 form V-shaped fracturing groove 75.

The hand tool 50 is formed from a suitable grade of tool steel, as by employing an appropriate automatic screw machine, with the handle 54 being initially formed straight and later bent using a suitable means to the right angled configuration shown in FIG. 4. After shaping to the form indicated in the drawings, head portion 52, frangible connection 56 and reduced shank portion 72 are hardened, as by employing suitable heating and quenching procedures.

The seal 10 as supplied, together with the hand tool 50, will have, as a subassembly, the cable 12, and retainer 14, with the cable end 80 fixed to retainer 14, and the cable end 82 free of the retainer 14 in terms of being fixed thereto.

Figure 5:
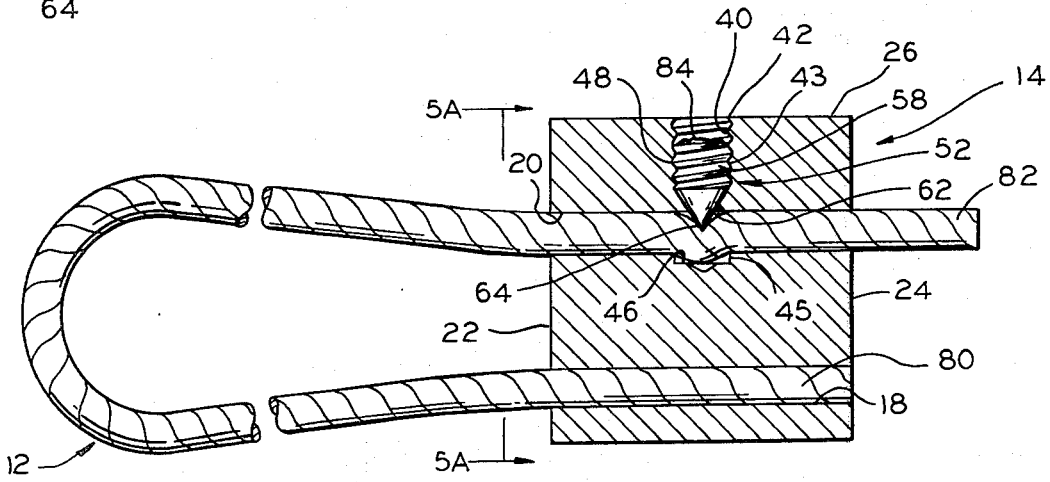
FIG. 5 is a sectional view through the seal retainer taken substantially along line 5—5 of FIG. 3 and showing the seal tie member fixed in locked relation to the seal retainer in accordance with the present invention.

In accordance with the invention, the cable end 80 is fixed to the body 16 by having the end 80 extended into the through passage 18 and then the body 16 compressed or worked to close the passage 18 against the cable end 80. For this purpose ridge 36 is provided and in one way of fixing the cable end 80 to the retainer 14, the body 16 with the cable end 80 applied to its passage 18 substantially as shown in FIG. 5 is rested on a suitable anvil or the like by applying its underside 24 thereto, and then ridge 36 is hammered downwardly to drive the metal forming ridge 36 toward the underlying cable end 80 to firmly bind the cable end 80 and the retainer 14 together in a manner comparable to the showing of FIG. 5A. The same processing of the cable 12 and retainer 14 may be accomplished by using suitable clamping tools that are effective to compress the material of ridge 36 into the metal mass of the body overlying the passage 18, to substantially the level of the floors 33 and 35 of the respective grooves 32 and 34. FIG. 5A indicates approximately how the assembled retainer 14 and cable end 80 look in their assembled relation in a typical application of this embodiment of the invention.

For merchandising purposes, the cable end 82 may be left free of the retainer 14, or may be inserted into the through passage 20, for ease of handling and packaging, and packaged together with a hand tool 50 that is to accompany the seal 10, whereby a cable seal kit is provided.

When the seal 10 is to be provided and used, the cable end 82, of an assembled retainer 14 and cable 12 (of such a kit) with its free end 82 free of securement to retainer 14, is pulled from the through passage 20, if it is not already free of the through passage 20, and then applied about the two components to be sealed together shackle fashion, after which the cable end 82 is passed through passage 20 to substantially the relation indicated in FIG. 5.

The person applying the seal 10 then grasps the kit hand tool 50 by its handle 68 and threads the screw body 58 into and through bore 40, by rotating the tool shank 66 about its longitudinal axis, which brings the tool working end 62 into bearing relation with the cable 12. The threading of the screw body 58 against the cable is continued until further rotational movement is not possible because of the resistance offered by the cable 12. This screwing action results in the pointed terminal portion 64 of the hand tool screw body 58 penetrating the cable, and the cable 12 being indented inwardly of the recess 46, substantially as indicated in FIG. 5.

The person applying the seal 10 then applies sufficient sidewise leverage to the hand tool 50 to break the frangible connection 56, thus leaving the screw body 58 within the bore 40 and holding the cable end 82 in locked relation within the retainer 14.

An important aspect of the invention is that the length of the screw body 58 relative to the bore 40 is such that when the screw body 58 is turned to the relative positioning of FIG. 5, the outwardly extending fractured end portion 84 of same, that is formed by the severing of the frangible connection 56, lies well within bore 40, and well inside its mouth 42.

Furthermore, it is an important aspect of the invention that the frangible connection 56 be such that when it is broken, the terminal end portion 84 will be hard and jagged to resist attempts to drill out screw body 58. The hardening of hand tool portions 52, 56 and 72 results in the metal forming connection 56 becoming brittle, which facilitates the indicated breaking off action, and the jagged broken off end portion in being hard and uneven so resists the application thereto of drill bit ends that the needed initial formation by the drill bit of a starting bit centering concavity for effective drilling purposes is effectively prevented.

After application of the screw body 58 and the breaking off of the handle 54, the handle 54 may be discarded.

The result is that the seal 10 as applied has cable end 82 firmly fixed to same padlock fashion and where the cable 12 is in the form of commerical steel cabling and the retainer 12 is formed from aluminum or the like, the retainer 10 will firmly resist efforts to pry one end or the other of the cable 12 from the retainer 14. Further, tampering efforts of this type will clearly mark the cable 12 and the retainer 14 to show that tampering has taken place.

Figure 6:
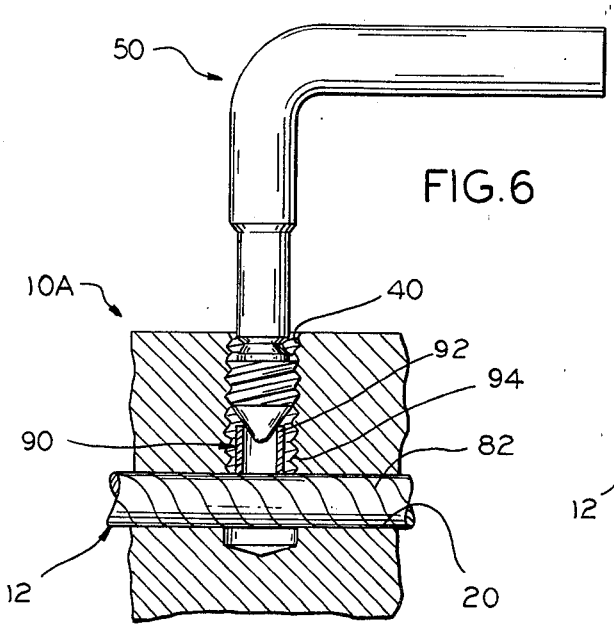
FIG. 6 is a fragmental sectional view of the seal retainer and associated tie member illustrating the hand tool of FIG. 4 being applied thereto, and also showing a modified form of the invention.

Referring now to the embodiment of FIGS. 6 and 7, the basic components of the seal 10A are the same as described in connection with the embodiment of FIGS. 1–5. In the seal 10A, when the seal is being applied, after the cable end 82 has been inserted through the through passage 20, and before the hand tool 50 is applied thereto, a sleeve 90 is slipped into the bore 40, this then followed by the hand 58 of hand tool 50. Sleeve 90 is proportioned substantially as indicated in FIG. 6 so that the trailing end 92 of the sleeve 90 engaged by the conical working end 62 of the body 58, while the leading end 94 of the sleeve 90 bears against the cable 12.

The hand tool 50 is operated in the case of the seal 10 to press the sleeve 90 inwardly of the bore 50, thus dividing it about either side of cable 12, at its end 94, and expanding the sleeve 90 at its end 92.

Figure 7:
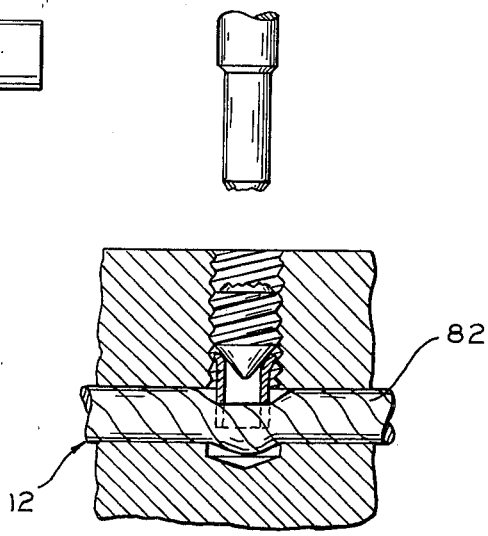
FIG. 7 is a view similar to that of FIG. 6, but showing the seal tie member fixed to the retainer and the hand tool handle in the process of being removed from the retainer.

The turning action on the screw body 58 is continued until the sleeve 90 has indented the cable 12 into the recess 46, substantially as indicated in FIG. 7, at which point the sleeve 90 will be collapsed endwise against and about the cable in a saddle like manner. Forward progress of the screw body 58 in the direction of the cable is stopped by the binding of the parts involved. The handle 50 is then removed in the same manner as before, to leave the screw body 58 recessed within the bore 40 and set against the sleeve and cable to lock the cable end 82 to the retainer.

Figure 8:
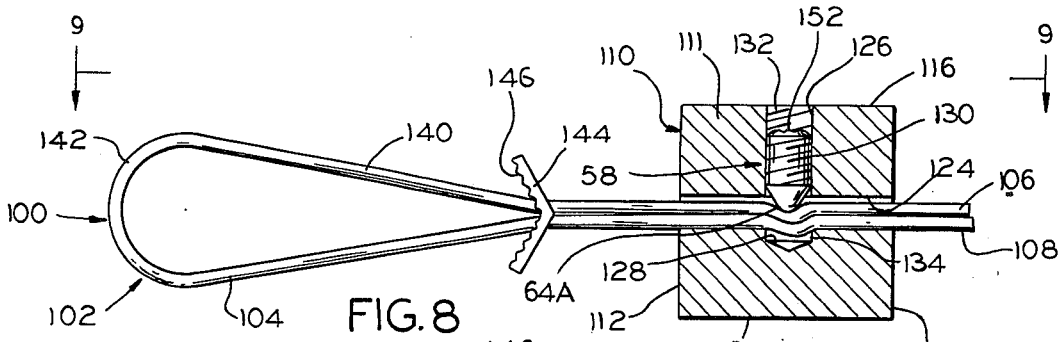
FIG. 8 is a diagrammatic plan view of a money bag seal arranged in accordance with the present invention, shown on an enlarged scale, and with the seal retainer shown in section.
Figure 9:
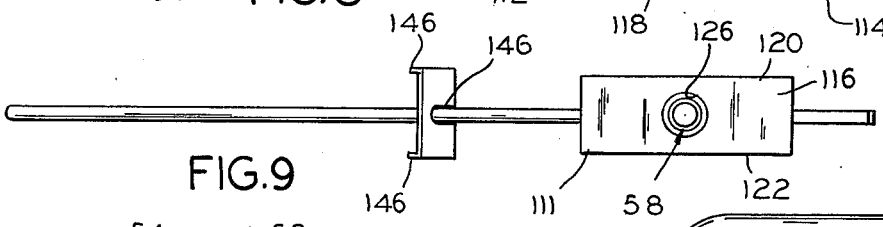
FIG. 9 is an edge view of the security seal shown in FIG. 8 and viewed along line 9—9 of FIG. 8.

Turning now to the embodiment of FIGS. 8 and 9, the principles of the invention are employed to provide a money bag seal 100 that comprises a tie member 102 in the form of a length of cord 104 defining end portions 106 and 108. Associated with the cord 104 is retainer 110 formed from aluminum or lead, or other suitable metallic material. Body 110 is of parallelepiped configuration defining planar end walls 112 and 114, planar relatively narrow side walls 116 and 118, and relatively wide side walls 120 and 122. The body 111 is thus flat or planar in configuration as indicated in FIG. 9, and it is formed with a single through passage 124 extending along its mid portion between the respective walls 112 and 114. Body 111 is also formed with cross bore 126 that is comparable to the bore 40 of the seal 10, with the bore 126 extending crosswise of through passage 124 and beyond same to define internal recess 128 in the same manner that bore 40 defines recess 46.

As indicated by FIGS. 8 and 9, the through passage 124 and the bore 126 are in coplanar relation in the plane of the body 111.

The bore 126 thus defines outer section 130 that is internally screw threaded as at 132, and inner section 134 that forms the recess 128.

The tie member 102 in being arranged for marketing as a money bag seal has its ends 106 and 108 pulled through the through passage 124 to define loop 140 on one side of the retainer 110 that includes bight portion 142. The cord 104 in the form shown is equipped with the conventional angled abutment piece 144 that is slotted as at 146 to receive the cord lengths defining the loop 140. The abutment 144, which may be formed from sheet metal, is commonly formed with toothed flanges 146 along its upper and lower edges for improving the gripping action it is to have on the money bag.

Figure 4:
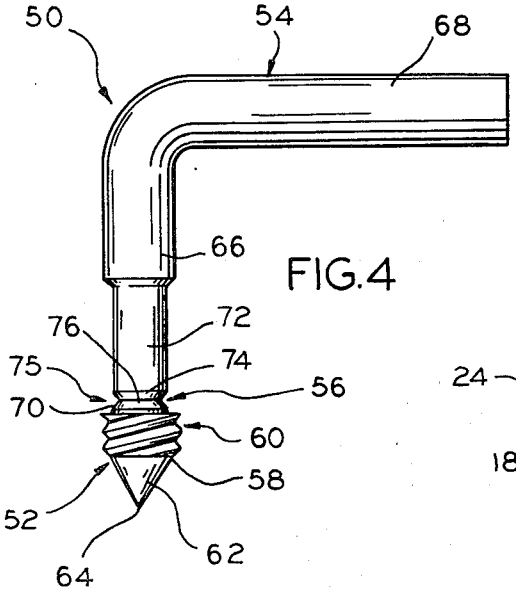
FIG. 4 is a plan view of the screw head hand tool that is associated with the security seal of FIGS. 1–3.
Figure 10:
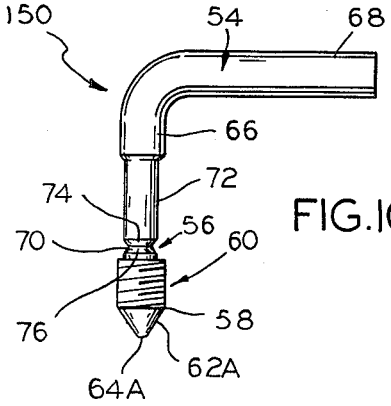
FIG. 10 is a plan view of the screw headed hand tool employed in the embodiment of FIGS. 8 and 9.

Associated with the money bag seal 10 is the screw headed hand tool 150 shown at FIG. 10, which in all respects is the same as that shown in FIG. 4, but has a size proportioned for use with money bag seals that in general involve a retainer that is substantially smaller than the retainers of cable seals, and in practice will have a length and width dimension comparable to the diameter of a dime or nickel.

The tool 150 thus bears reference numerals corresponding to those of FIG. 4 indicating like parts. However, in this embodiment of the invention, the working end 62A of hand tool 150 has a rounded apex 64A rather than the pointed apex 64 of the embodiment of FIG. 4, to avoid penetrating cord 104.

The hand tool 150, as in the case of hand tool 50, may be formed from a suitable tool steel or the like, and is the same as tool 50, except it is proportioned in size in accordance with the smaller size money bag seals are made in, as compared to cable seals.

In using the money bag seal 100, and the tool 150 associated therewith, the seals 100 and tools 170 are usually supplied in quantity to the facility that is involved in packaging money in bags. When a bag is to be sealed closed, a seal 100 is grasped, which at this stage will have the cord 104 and bag abutment 144 applied thereto substantially as indicated in FIGS. 8 and 9, but with the bore 126 fully open, and thus free of the hand tool 150 and/or its screw head 52. The loop 140 defined by the tie member 102 will be open sufficiently to receive the open end of the money bag, after which the cord ends 106 and 108 are simultaneously pulled to the right of FIGS. 8 and 9 relative to the retainer 110 to pull the money bag open end closed and against the abutment 144, which in turn is seated against the end wall 112 of the retainer 10. With the cord held to tightly hold the bag and abutment 140 against the retainer, a hand tool 150 is grasped and its screw head 52 applied to the bore 126 in the same manner as in the case of the seal 10, with the tool being turned to thread the screw body 58 toward and into engagement with the cording crossing the bore 126. This turning action is continued until the cording is deflected into the recess 128 as far as the cording will go and the hand tool can be turned in the inward threading direction. The handle 54 is then broken off at the frangible connection 56 to leave the hand tool screw body 58 recessed within bore 126 in bearing engagement with the cording, which is thus locked in a fully enclosed manner to the retainer 110 within same. As in the case of tool 50, the terminal end portion 152 of the screw body 58 is hard and jagged, to resist drilling out.

Similar to the seal 10, the broken off portion of the hand tool 150, namely the handle 54 and associated parts, may be thrown away. In the showing of FIGS. 8 and 9, the money bag is omitted to simplify the illustration.

As is the case with money bag seals in general, the money bag seal 100 is not designed to have any particular high strength characteristics for resisting extreme efforts to separate the parts of seal 100. Its primary function is to securely hold the money bag closed, and provide evidence that the seal has not been tampered with by being free from markings that would suggest tampering. The seal 100 to be opened or broken requires that the seal 100 be destroyed, as by cutting the cord 104.

It will thus be seen that in the money bag seal 100, the binding of the cords to the retainer 110 is achieved by using the basic screw head arrangement of this invention. Money bag seals conventionally require that the retainer be of lead or other relatively soft material from which the retainer is formed be compressed using suitable clamping tools to bind the cording to the retainer. This is avoided in accordance with the present invention with the only tool thus required to apply the seal being the associated hand tool 150.

Figure 11:
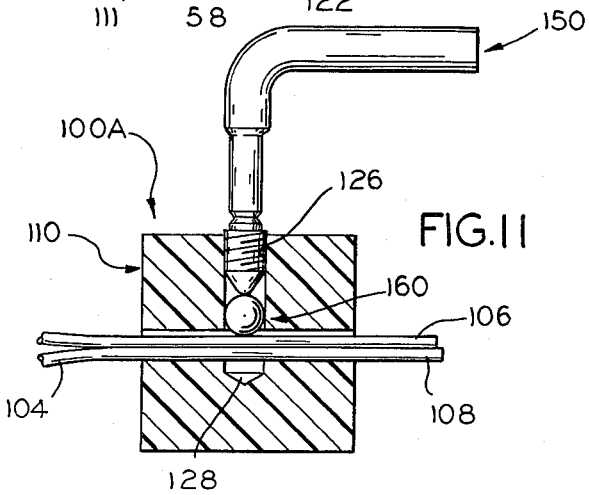
FIG. 11 is a view similar to that of FIG. 8 with the tie member shown fragmentally and the hand tool shown in use, illustrating a varient form of the embodiment of FIGS. 8–10.

In the money bag seal arrangement 100A of FIG. 11, all the component parts involved are the same as for seal 100, and in addition, a globe or ball formed from lead or zinc or other suitable malleable material, generally indicated by reference numeral 160 is applied to the bore 126 ahead of the hand tool screw body 158, when the cord 104 is to be made fast to the retainer 110. With the ball 160 positioned as indicated in FIG. 11, the hand tool 150 is turned to thread the screw body 58 into and along the bore 126 to press the ball 160 against the cording crossing the bore 126, which thus indents the cording into the recess 128. As the turning action of the hand tool proceeds, the ball 160 is compressed into a semi deformed flattened relation in intermittent engagement with the cording to firmly fix same to the retainer 110. The seal 100A is otherwise the same as seal 100.

In the form of FIG. 11, the retainer is shown as being formed from a suitable plastic material, such as polyethylene or polypropalene. Hand tool 150 may also be formed from the same material in the case of the embodiments of FIGS. 8–11 so that the money bag seals provided may be of an all plastic nature, except, of course, for the cord 104 and the money bag abutment 144. In these alternate embodiments the globe 160 may be omitted or may be in the form of lead for flattening against the cording to bind same in place within the retainer.

Figure 12:
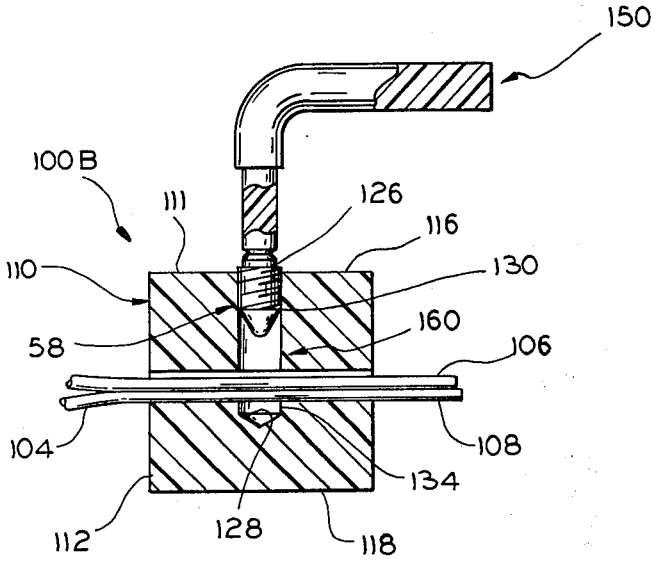
FIG. 12 is a view similar to that of FIG. 8, with the tie member shown fragmentally and the hand tool in use, illustrating another varient form of the embodiment of FIGS. 8–10.

FIG. 12 illustrates a money bag seal 100B that is the same as seal 100 except that both retainer 110 and hand tool 150 are both of all plastic construction, using, for instance, polyethylene.

It will thus be seen that the invention provides a simplified, enclosed, and highly effective way of binding the seal tie member to its retainer in the case of cable seals, money bag seals, and the like. Other than the hand tool herein disclosed, no other tools are required to apply the seal. When use of the hand tool is completed, its handle is broken off and disposed of, and in any event if it remains in the area where the seal is applied, it is not usable to retract the screw head of the seal. The screw head of the seal is recessed within the retainer and set against the retainer tie member involved at a location that is hidden within the retainer. The outwardly directed end of the screw head in the area of its fractured surfacing is of conical configuration or at least roughly convex to resist efforts to drill same out of the retainer.

The tie member employed as part of security seals in accordance with the invention may be of the cable type illustrated in connection with the cable seal 10, but it also may be in the form of a single strand of wire. The tie member for money bag seals and the like may be in the form of string or yarn, in addition to cording.

In the money bag seal arrangements of FIGS. 8–12, the retainer 110 need not be polygonal in configuration, but may be round. However, the retainer must be planar comparable to the showing of FIGS. 8 and 9 and be proportioned in thickness relative to the tie member employed in roughly the proportion indicated in FIG. 9.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. Security seal forming implements for providing a cable seal type security seal for padlock fashion locking and security sealing purposes, said implements comprising:

a cable seal subcombination including:

a retainer body formed from a metallic material and defining oppositely directed end portions, and opposed edge portions on either side of said body extending between said end portions, respectively, said body further defining an elongated substantially rectilinear passage adjacent one of said edge portions and extending from one of said body end portions in the direction of the other of said body end portion, said body having a rectilinear bore formed therein extending from said one edge portion of said body and intersecting said passage substantially normally thereof and defining a mouth in said body at said one edge portion thereof and a recess in said body that is beyond said passage from said bore mouth, said bore having an internally threaded portion between said mouth thereof and said passage and disposed adjacent said passage, a length of cable anchored to said body at said body one end portion adjacent the other of said body edge portions, said cable projecting from said body one end portion and having a free end proportioned lengthwise thereof to be inserted in said body passage from said body one end portion across and beyond said bore for shaping said cable shackle fashion in the body passage inserted relation of said cable free end, and a one piece hand tool formed from tool steel for making said cable fast to said body at said bore and comprising:

a screw head having a threaded portion proportioned for threaded engagement with said bore threaded portion, said screw head defining a protuberant working end for application against the cable when said cable free end thereof is in said body passage inserted relation thereof, a handle including a shank portion that is integral with said screw head in aligned rectilinear relation and an elongated hand grip portion that is angularly disposed relative to said shank portion, said screw head threaded portion lengthwise of said head having a length that is less than said bore threaded portion, said tool shank portion having formed in juxtaposition to said head an annular groove thereabout, said hand tool being hardened at said screw head and from said screw head into said shank portion including and across said groove whereby said groove forms a frangible connection between said screw head and said handle, whereby when said cable is in its said body passage inserted relation thereof, said hand tool screw head may be threaded into said body bore threaded portion for making said cable fast to said body at said bore by hand gripping and moving said handle to rotate said screw head so as to make same fast within said body bore with said screw head protuberant end directed against said cable as needed to deflect said cable into said bore recess, and said hand tool handle may be separated from said head at said groove, by sidewise deflecting said handle relative to said shank portion to fracture said hand tool at said groove, and discarded, with said screw head remaining in said bore and defining a hardened jagged surfacing across the fracture that is recessed in said bore below said bore mouth whereby said screw head is resistant against being drilled out.

2. The implements set forth in claim 1 wherein:

said screw head working end is pointed for penetrating the cable when said screw head has been turned in said bore to deflect the cable into said recess.

3. The implements set forth in claim 1 wherein:

said passage is a through passage between said body end portions.

4. The implements set forth in claim 3 wherein said cable is embedded in said body along and lengthwise of said other body edge portion.

5. The implements set forth in claim 1 wherein:

said body is generally parallelepiped in configuration, with said end portions being in substantial parallelism and extending normally of said passage, said passage being a through passage, said bore substantially paralleling said body end portions, and said cable free end extending through said passage.

6. The implements set forth in claim 1 including:

a deformable sleeve proportioned for application to said body bore between said screw head protuberant end and said cable for deformation about cable as said screw head is made fast in said body bore.

* * * * *